US005554417A

United States Patent [19]

Heming

[11] Patent Number: 5,554,417

[45] Date of Patent: Sep. 10, 1996

[54] CONVERTIBLE PACKAGING AND HANDLE UNIT

[75] Inventor: Dwight A. Heming, Warrensburg, Mo.

[73] Assignee: Pittsburgh Corning Corporation, Pittsburgh, Pa.

[21] Appl. No.: 426,024

[22] Filed: Apr. 21, 1995

[51] Int. Cl.[6] ..... B05D 3/00

[52] U.S. Cl. ..... 427/445; 15/104.94; 15/244.1; 134/42; 451/28

[58] Field of Search ..... 15/104.94, 244.1; 134/42; 427/445; 451/28

[56] References Cited

U.S. PATENT DOCUMENTS 3,286,294 11/1966 Raffe ..... 15/104.94

3,737,939 6/1973 Jones ..... 15/104.94

5,371,917 12/1994 Hoagland ..... 15/244.1

*Primary Examiner*—Michael Lusignan

*Attorney, Agent, or Firm*—Gene A. Tabachnick; Maria N. Rullo

[57] ABSTRACT

A convertible packaging and handle unit that attaches to an object to facilitate the packaging and use of the object, the convertible unit including a first portion adapted for attachment to the object and a second portion positionable into a plurality of positions, wherein in a first position the second portion encloses at least a portion of the object and in a second position the second portion is operable to manipulate the object.

21 Claims, 1 Drawing Sheet

CONVERTIBLE PACKAGING AND HANDLE UNIT

FIELD OF THE INVENTION

The present invention relates in general to packaging and material handling devices and, more particularly, to a convertible packaging and handle unit that is attachable to an object for facilitating the packaging/enclosure and use of the object.

BACKGROUND OF THE INVENTION

Many objects are difficult, dirty and/or unsafe to use with bare hands. These same objects often require some form of packaging for effective transportation, storage and/or disposal purposes. Examples of such objects include but are not limited to: (1) abrasive objects, wherein such objects are formed of an abrasive material or have at least one abrasive surface, such as grill cleaning objects, steel wool, sandpaper, other scraping objects, and the like, for use in the removal of such items as residual food deposits on a grill, paint, stains, etc.; (2) applicators, wherein such applicators are made of an applicating material or have at least one applicating surface, such as objects for waxing and polishing furniture or cars and for painting, staining or varnishing items such as furniture, etc.; and (3) cleaning objects, wherein such objects are formed of a cleaning material or a material capable of receiving cleaning fluids, pastes, sprays and the like, such as washing objects, scrubbing objects, sponges soaked with cleaning fluids, as well as drying objects, buffing objects, and the like, for cleaning, drying and buffing various types of surfaces.

The convertible packaging and handle unit of the present invention provides a convenient, simple and cost effective manner for facilitating the safer, easier, more effective and cleaner use of such objects while simultaneously enabling more effective transportation, storage and/or disposal of such objects. Although the present invention is described in terms of a packaging and handle unit for use in connection with such objects as enumerated above, such objects have been set forth for illustrative purposes only and it is contemplated that the present invention may find beneficial use in a variety of other applications as well.

SUMMARY OF THE INVENTION

The present invention relates to a convertible packaging and handle unit that may be fixedly or releasably attached to an object.

Many objects, such as abrasive objects, applicators and cleaning objects are difficult, dirty and/or unsafe to use with bare hands. These same objects often require some form of packaging for effective transportation, storage and/or disposal. The present invention provides a desirable solution to the dual problem associated with the use and packaging of such objects.

The present invention is convertible among a variety of positions including at least two primary positions, i.e., an enclosing position and a handle position. The invention serves a different function in each position. When in a position that encloses at least a portion of the object, the present invention acts as a sort of packaging for protection during shipping or transportation, along with plastic shrink wrap. And, when it is desired to use the object, the present invention may be converted from the enclosing position to a handle position, wherein a handle is formed to facilitate the effective manipulation of the object. After use, the present invention may be reconverted from the handle position to the enclosing position to facilitate the safe, clean and efficient storage of the object or, if the object has exhausted its useful purpose, to facilitate the safe, clean and efficient disposal of the object.

DESCRIPTION OF THE DRAWINGS

In the accompanying drawings, preferred embodiments of the invention are illustrated by way of example only, wherein.

DESCRIPTION OF THE PREFERRED EMBODIMENTS

Figure 1:
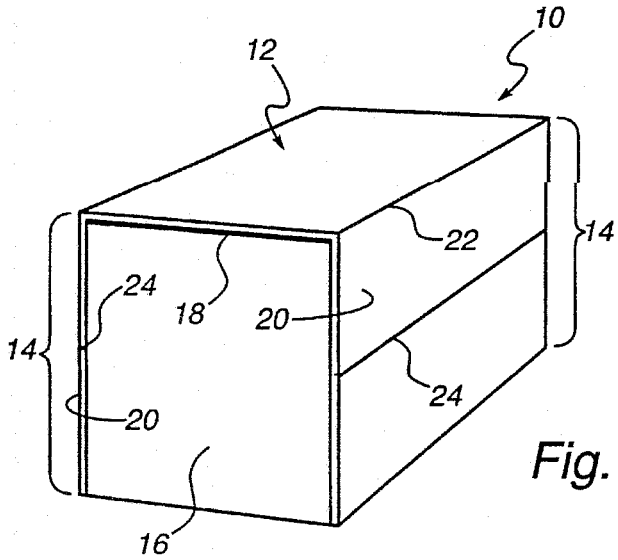
FIG. 1 is a perspective view of a preferred embodiment of the packaging and handle unit of the present invention in which the unit is disposed in a first or object enclosing/packaging position.

The convertible packaging and handle unit 10 of the invention serves the dual purpose of facilitating the use of an object 16 as well as the packaging or enclosure of the object 16 for such purposes as transportation, storage and disposal.

The convertible packaging and handle unit 10 of the present invention preferably comprises a first portion 12 and a second portion 14. The first portion 12 is adapted for attachment to an object 16 including, but not limited to, an abrasive object, an applicator, a cleaning object and the like. In a presently preferred embodiment the first portion 12 is attached to an object 16, e.g., an abrasive grill cleaning object such as a GRILL-BRICK™, which is manufactured by Pittsburgh Corning Corporation of Pittsburgh, Pa. It will be understood, however, that object 16 may alternatively be an applicator object including means for applying a substance to a surface, or a cleaning object including means for cleaning or drying a surface, or still some other object. The first portion 12 may be attached to the object 16 by any suitable means, such as an adhesive, staples, clips and the like 18. Care should be taken when selecting a glue-type adhesive if the attached object 16 is to be used on hot surfaces, such as grills, due to the potential for the release of noxious fumes from the adhesive when exposed to heat. In the presently preferred embodiment, DAP® (an FDA approved silicon adhesive) or other suitable adhesive may be used for the purpose of attaching the object 16 to the first portion 12 to create a permanent adhesive joint 18.

Figure 2:
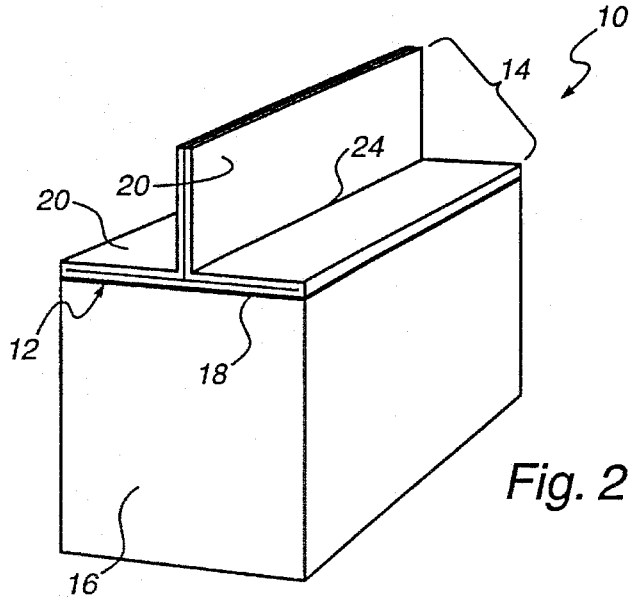
FIG. 2 is a perspective view of a preferred embodiment of the packaging and handle unit of the present invention in which the unit is disposed in a second or full handle position.
Figure 3:
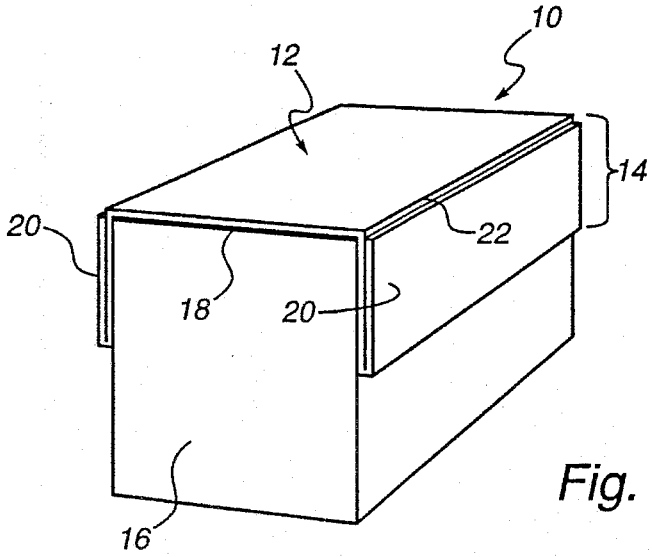
FIG. 3 is a perspective view of a preferred embodiment of the packaging and handle unit of the present invention in which the unit is disposed in a second or alternative handle position.

The second portion 14 is comprised of at least one flap 20 and is positionable into a variety of positions including a first position as shown in FIG. 1, wherein the second portion 14 encloses or packages at least a portion of the object 16 and a second or full handle position, as shown in FIG. 2, wherein the second portion 14 acts as a handle to facilitate manipulation of the object 16. In a preferred embodiment, the second portion 14 is comprised of two flaps 20 as shown in FIGS. 1, 2 and 3.

In a preferred embodiment, the first portion 12 and the second portion 14 are formed of one continuous piece of thin-flute corrugated cardboard that is bendable along fold lines 22 where the first portion 12 meets each of the flaps 20 comprising the second portion 14. The use of such cardboard allows for optimal operability of the packaging and handle unit because the cardboard is sufficiently sturdy and durable to facilitate the effective manipulation of the attached object 16 while in the handle positions, yet sufficiently flexible to allow for bending and folding to facilitate conversion between the enclosing position and various handle positions and vice versa. While thin-flute corrugated cardboard is preferred, the first portion 12 and the second portion 14 may be made of any suitable material, such as plastic, non-corrugated cardboard and the like. It is contemplated, however, that the first portion 12 and the second portion 14 be made of inexpensive, disposable materials. Further, the first portion 10 and the second portion 12 may be formed of separate pieces of the same material or different materials. In this event, the second portion 14 may be connected to the first portion 12 in a hinge-like manner to create joints at the positions of the fold lines 22 in the preferred embodiment.

The preferred embodiment also includes double fold lines 24 located lengthwise approximately in the middle of each flap 20 of the second portion 14, which double fold lines 24 may be created by linearly crushing the thin-flute corrugated cardboard. As shown in FIG. 3, the double fold lines 24 allow the flaps 20 of the second portion 14 to be bent back against themselves while still partially enclosing the object 16. When disposed in such a manner, the flaps form an alternative handle as shown in FIG. 3, which handle position allows for a very firm grip on the object 16 until the object 16 is worn down to the double fold lines 24, at which point the user may fold the second portion 14 into the full handle position, as shown in FIG. 2. The primary advantage of the double fold lines 24 is to reduce fatigue on the adhesive joint or attaching means 18 between the first portion 12 and the attached object 16, while still providing a firm means for grasping the object 16. It is contemplated that the second portion 14 may be provided with a number of additional fold lines at various locations to allow for different degrees of handles as the attached object 16 may warrant to facilitate the optimal use of the object 16 and to reduce fatigue on the adhesive joint or attaching means 18.

The preferred embodiment further comprises a means for securing the second portion 14 into the second or full handle position, including but not limited to adhesives, staples, clips, snaps, Velcro® or similar mating hook and loop fasteners and the like, as the circumstances warrant. In another embodiment, the flaps 20 of the second portion 14 may be provided with perforated areas so that when the second portion 14 is in the full handle position the perforated areas may be separated from the flaps along the perforations, thereby creating apertures, and caused to engage in an interlocking fashion to secure the second portion 14 into the full handle position. Such apertures facilitate grasping of the object 14 by a human hand to promote the safe, clean and effective manipulation and carrying of the object.

In another embodiment, the first portion 12 may be releasably attached to an object 16 by such means as including but not limited to tacks, staples, snaps, Velcro® or similar mating hook and loop fasteners and the like.

Although the present invention has been described in detail for the purpose of illustration, it is to be understood that such detail is solely for that purpose and that variations can be made therein by those in the art without departing from the spirit and scope of the invention except as it may be limited by the claims.

What is claimed is:

1. A convertible packaging and handle member comprising:

a first portion adapted for attachment to an object; and a second portion positionable into a plurality of positions, the second portion including a first flap and a second flap, each of the first and second flaps including at least a first fold line and a second fold line, wherein in a first position the second portion encloses at least a portion of the object and in a second position the second portion is operable to manipulate the object.

2. The convertible packaging and handle member of claim 1 further comprising means for securing the second portion in the second position.

3. The convertible packaging and handle member of claim 1 wherein the object is an abrasive object.

4. The convertible packaging and handle member of claim 1 wherein the object is an applicator object.

5. The convertible packaging and handle member of claim 1 wherein the object is a cleaning object.

6. A system including an object and means for packaging and handling the object, comprising:

(a) a convertible packaging and handle member including:

a first portion adapted for attachment to an object;

a second portion positionable into a plurality of positions, the second portion including a first flap and a second flap, each of the first and second flaps including at least a first fold line and a second line, wherein in a first position the second portion encloses at least a portion of the object and in a second position the second portion is operable to manipulate the object; and (b) an object attached to the first portion and adapted to be alternately enclosed and manipulated by the convertible packaging and handle member.

7. The system of claim 6 further comprising means for securing the second portion in the second position.

8. The system of claim 6 wherein the object is an abrasive object.

9. The system of claim 6 wherein the object is an applicator object.

10. The system of claim 6 wherein the object is a cleaning object.

11. A method for converting packaging into a handle, comprising the steps of:

(a) attaching a first portion of a convertible packaging and handle member to an object; and (b) positioning a second portion of the convertible packaging and handle member from a first position, wherein the first portion encloses at least a portion of the object, to a second position, wherein the second portion is operable to manipulate the object, the second portion including a first flap and a second flap, each of the first and second flaps including at least a first fold line and a second fold line.

12. The method of claim 11 further comprising the step of securing the second portion in the second position.

13. The method of claim 11 wherein the object is an abrasive object.

14. The method of claim 11 wherein the object is an applicator object.

15. The method of claim 11 wherein the object is a cleaning object.

16. (Amended) A method for abrading a surface comprising the steps of:

(a) attaching a first portion of a convertible packaging and handle member to an abrasive object;

(b) positioning a second portion of the convertible packaging and handle member from a first position, wherein the first portion encloses at least a portion of the object, to a second position, wherein the second portion is operable to manipulate the abrasive object, the second portion including a first flap and a second flap, each of the first and second flaps including at least a first fold line and a second fold line; and (c) manipulating the abrasive object to abrade the surface.

17. The method of claim 16 further comprising the step of securing the second portion in the second position.

18. A method for applying a substance, comprising the steps of:

(a) attaching a first portion of a convertible packaging and handle member to an applicator adapted to apply a substance;

(b) positioning a second portion of the convertible packaging and handle member from a first position, wherein the first portion encloses at least a portion of the object, to a second position, wherein the second portion is operable to manipulate the applicator, the second portion including a first flap and a second flap, each of the first and second flaps including at least a first fold line and a second fold line; and (c) manipulating the applicator to apply the substance.

19. The method of claim 18 further comprising securing the second portion in the second position.

20. A method for cleaning a surface comprising the steps of:

(a) attaching a first portion of a convertible packaging and handle member to a cleaning object;

(b) positioning a second portion of the convertible packaging and handle member from a first position, wherein the first portion encloses at least a portion of the object, to a second position, wherein the second portion is operable to manipulate the cleaning object, the second portion including a first flap and a second flap, each of the first and second flaps including at least a first fold line and a second fold line; and (c) manipulating the cleaning object to clean the surface.

21. The method of claim 20 further comprising the step of securing the second portion in the second position.

* * * * *